US005605014A

United States Patent [19]

Kimura

[11] Patent Number: 5,605,014

[45] Date of Patent: Feb. 25, 1997

[54] DOOR APPARATUS FOR REST ROOM

[75] Inventor: Motoyasu Kimura, Tokyo, Japan

[73] Assignee: Kimura Industry Co., Ltd., Japan

[21] Appl. No.: 336,425

[22] Filed: Nov. 9, 1994

[30] Foreign Application Priority Data

Nov. 16, 1993 [JP] Japan ..... 5-286970
Nov. 16, 1993 [JP] Japan ..... 5-286971

[51] Int. Cl.[6] ..... E06B 3/34

[52] U.S. Cl. ..... 49/40; 4/607; 49/387; 52/65; 52/79.1

[58] Field of Search ..... 49/40, 41, 387, 49/171; 52/34, 79.1, 65; 4/607, 449, 460, 462, 557

[56] References Cited

U.S. PATENT DOCUMENTS

| | | | |
|---|---|---|---|
| 609,774 | 8/1898 | Burner | 49/387 |
| 3,399,501 | 9/1968 | Rossman | 52/65 X |
| 4,665,584 | 5/1987 | Williams . | |

FOREIGN PATENT DOCUMENTS

| | | | |
|---|---|---|---|
| 0086931 | 8/1983 | European Pat. Off. . | |
| 2590313 | 5/1987 | France . | |
| 2669075 | 9/1990 | France . | |
| 5106382 | 4/1993 | Japan | 49/40 |
| 96433 | 4/1921 | Switzerland | 49/171 |
| 388886 | 12/1931 | United Kingdom . | |
| 2014225 | 8/1979 | United Kingdom . | |

OTHER PUBLICATIONS

European Search Report—Application No.EP 94 30 8259.
Patent Abstracts of Japan—Publication No. JP5044348, vol. 17, No. 346 (M-1437) 30 Jun. 1993.
Patent Abstract of Japan—Publication No. JP5106382, vol. 17, No. 465 (M-1468) 25 Aug. 1993.

*Primary Examiner*—Philip C. Kannan
*Attorney, Agent, or Firm*—Greer, Burns & Crain, Ltd.

[57] ABSTRACT

A door apparatus for a rest room includes a wall member defining a predetermined space and an opening for an entrance and an exit thereof; a door body for opening or shutting the opening, having a substantially half-cylindrical shape, being rotatable about a center of curvature of the half-cylindrical shape; and a driving device for driving and rotating the door body about the center of curvature. In a preferred embodiment, the driving device has a pulley with a peripheral shape of involute, a wire wound about the pulley, and a weight connected to an end of the wire. The weight is inserted into a tube receiving oil.

7 Claims, 14 Drawing Sheets

DOOR APPARATUS FOR REST ROOM

BACKGROUND OF THE INVENTION

1. Field of the Invention

This invention relates to a door apparatus for a rest room which is preferably used for a public comfort station, a rest room or a lavatory which is located at a public park or a lobby in a hotel, and in particular to a door apparatus which enable to improve used efficiency of the space in the rest room.

2. Description of the Related Art

Conventionally, a public comfort station is usually provided with a box-shaped construction which defines a rest room. Normally, a rectangular plate door is mounted on the construction at-the opening thereof through a hinge in a manner being able to open or shut.

The conventional comfort station fails considerably for use efficiency of the space in the rest room. In addition, although a conventional rest room includes a shelf or a stand on which one's personal belongings such as handbags are put (hereinafter referred as "shelf"), the surface of the shelf is apt to be so dirty that the user hesitate to put the belongings on the belongings putting stand.

SUMMARY OF THE INVENTION

The first object of the present invention is to provide a door apparatus for a rest room which improves use efficiency of the space in the rest room.

The second object of the present invention is to provide a door apparatus for a rest room which at the out side of the rest room allows easy and efficient cleaning of a personal belonging shelf.

The third object of the present invention is to provide a door apparatus for a rest room which allows a safety of the inside and the outside of the rest room to be easily confirmed.

The fourth object of the present invention is to provide a door apparatus for a rest room whereby a user can easily use a washing stand outside the rest room, and also can use a washing stand inside the rest room when using the rest room.

The fifth object of the present invention is to provide a door apparatus for a rest room in which a user can easily and quietly open or close the door, and can automatically close the door without using any electric source when he did not close the door enough with his hand.

To achieve these objects of the present invention, there is provided a door apparatus for a rest room, comprising: a wall member defining a predetermined space and an opening for an entrance and an exit thereof; a door body for opening or shutting the opening, having a substantially half-cylindrical shape, being rotatable about a center of curvature of the half-cylindrical shape; and means for driving and rotating the door body about the center curvature.

Further, the present invention provides a door apparatus for a rest room, comprising: a wall member defining a predetermined space and an opening for an entrance and an exit thereof; a door body for opening or shutting the opening, having a substantially half-cylindrical shape, being rotatable about a center of curvature of the half-cylindrical shape; and a door driving device for driving and rotating the door body about the center of curvature by applying a rotating torque.

Preferably, the door driving device includes: a pulley integrally connected to said door body, having a peripheral shape for applying the rotating torque; a wire wound about the pulley; a weight connected to an end of the wire.

The door driving device may include: a pulley integrally connected to the door body, having a peripheral shape of involute; a wire wound about the pulley; a weight connected to an end of the wire.

Further, the door driving device may include a dumping device found tube including therein a liquid such as oil into which a weight received and sinks.

In the configuration described above, the rotating torque is applicable according to the rotation of the door body, so that it is possible to rotate the door body with strong torque at an initial stage of the rotation, while with relatively weak torque at a later stage of the rotation. Further, as the weight sinks in oil within the tube, it is possible to shut the door body slowly and quietly.

Moreover, the present invention provides a door apparatus for a rest room comprising: a wall member defining a predetermined space and an opening for an entrance and an exit thereof; a door body for opening or shutting the opening, having a substantially half-cylindrical shape, being rotatable about a center of curvature of the half-cylindrical shape; a safety confirming window formed in the door body; a shutting member disposed on a side of the center of curvature, opening and closing the safety confirming window.

Preferably, the shutting member has a louver disposed in the safety confirming window and a lever for operating the louver.

Further, the predetermined space may include a toilet, and there is provided a wash-hand stand disposed in a place situated outside of the toilet when the door body is positioned so as to project toward the toilet, and situated in the space with the toilet when the door body is positioned so as to project away from the toilet.

A screen is preferably disposed on an outside of a radius of rotation of the door body. A motor can be provided for driving and rotating the door body.

In the configuration described above, a user can confirm the safety of the inside of the rest room through the safety confirming window when the rest room is vacant; also the user can confirm the safety of the outside of the rest room through the safety confirming window from the inside of the rest room. Further, since the safety confirming window can be operated from the rest room when the rest room is occupied, the user is prevented from being looked into from the out side of the rest room.

Moreover, a user can easily use the wash stand when the rest room is vacant, or while the user can use the wash-hand stand in the rest room when using the rest room. In addition, the privacy of the user can be protected by the screen when using the wash-hand stand at vacant state. Further, the user can easily open and shut the door body by the motor drive.

DETAILED DESCRIPTION OF THE PREFERRED EMBODIMENT

First Embodiment

Figure 1:
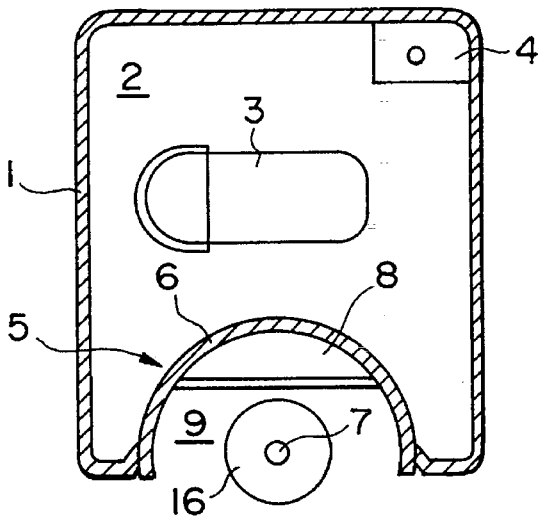
FIG. 1 is a cross sectional view showing the first embodiment of a door apparatus for a rest room according to the present invention.
Figure 2:
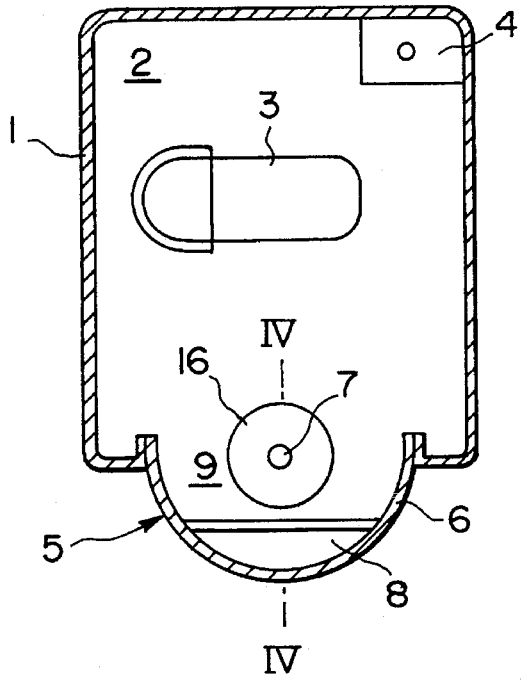
FIG. 2 is a cross sectional view showing the door apparatus for a rest room at another state different from FIG. 1.
Figure 3:
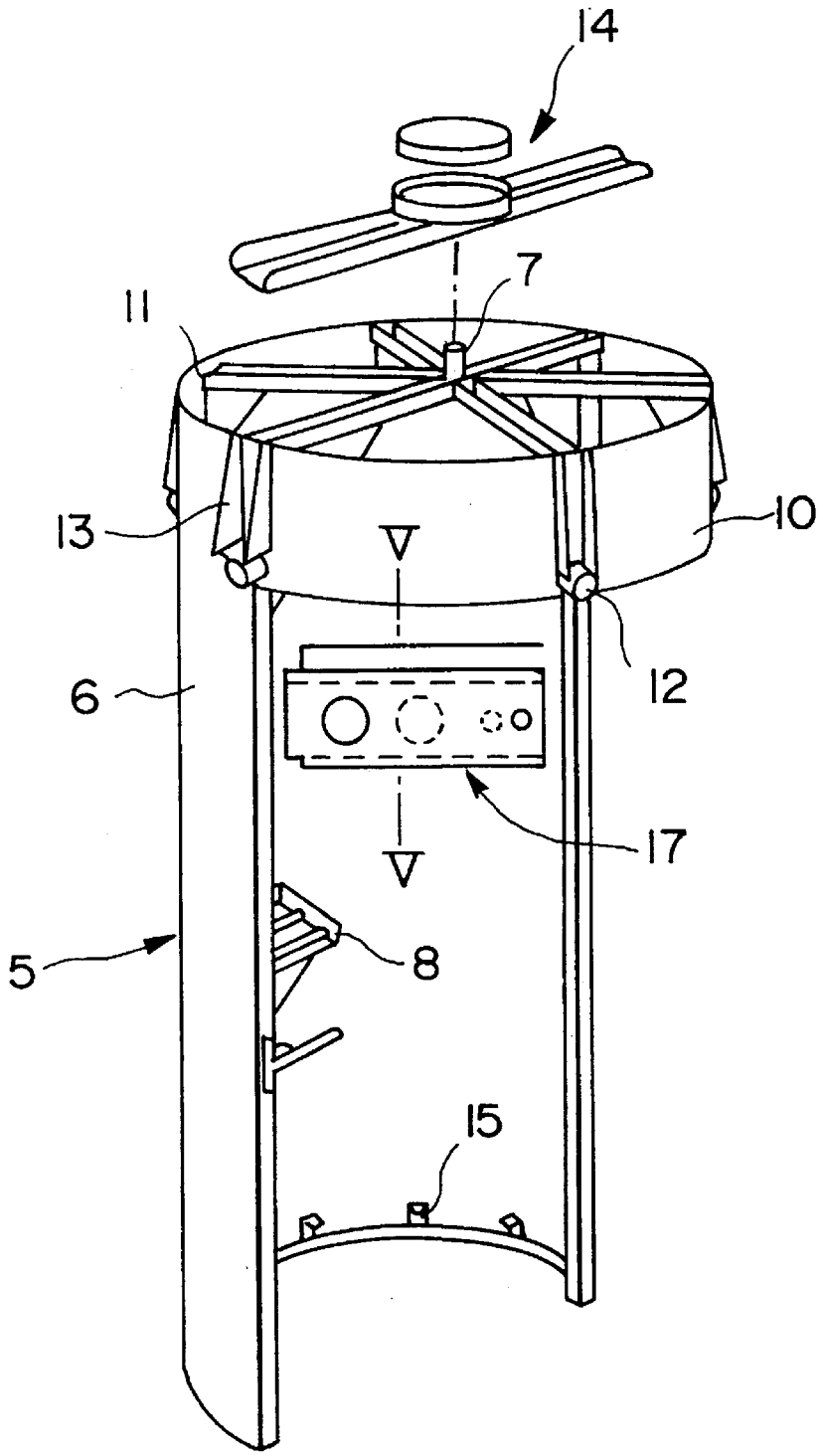
FIG. 3 is a perspective view showing the door apparatus for a rest room of FIG. 1.
Figure 4:
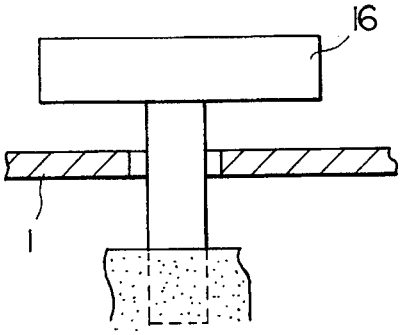
FIG. 4 is a side view showing a small-sized chair provided in the rest room, taken along line IV—IV in FIG. 2.
Figure 5:
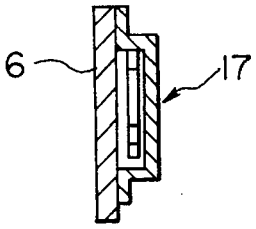
FIG. 5 is a cross sectional view showing a safety confirming window provided for the door apparatus, taken along the line V—V in FIG. 3.
Figure 6:
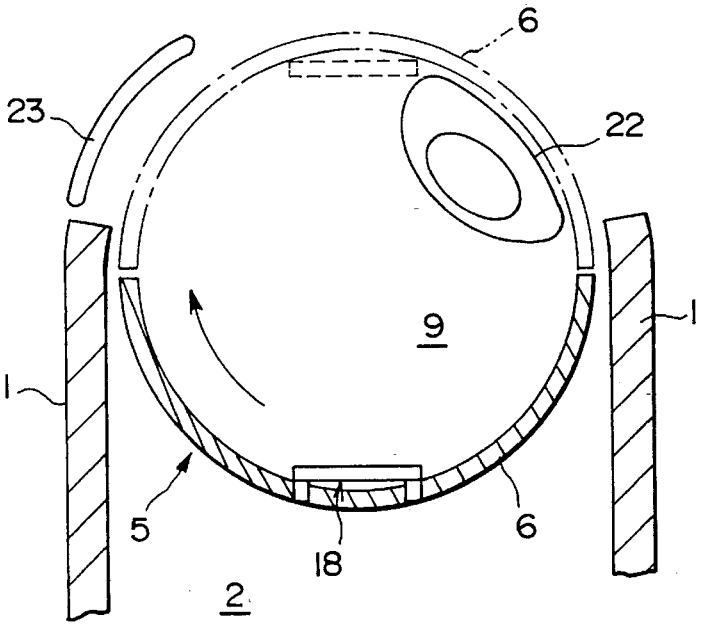
FIG. 6 is a cross sectional view showing the second embodiment of a door apparatus for a rest room.

FIG. 1 is a cross Sectional view showing the first embodiment of a door apparatus for a rest room, FIG. 2 is a cross sectional view showing the door apparatus at another state different from FIG. 1, FIG. 3 is a perspective view showing the door apparatus, FIG. 4 is a side view of a small-sized chair placed on the side of center of curvature of a door body, taken along in line IV–IV in FIG. 2, and FIG. 5 is a cross sectional view showing a safety confirming window of the door apparatus, taken along in line V—V.

In these drawings, reference numeral 1 denotes an outer wall, reference numeral 2 denotes a rest room, reference numeral 3 denotes a stool, reference numeral 4 denotes a wash-hand stand, reference numeral 5 denotes a door apparatus for a rest room, and reference numeral 6 denotes a door body of the door apparatus.

The door body 6 has a substantially half-cylindrical shape and is rotatably supported by a shaft 7 which has an axis extending in a vertical direction (refer to FIG. 3). Reference numeral 8 designates a belongings putting stand situated within a space surrounded by the door body 6. FIG. 1 indicates a state (state A).in which the door body 6 is positioned so as to projecting into the rest room to reduce the volume of the space of the rest room. FIG. 2 indicates a state (state B) in which the door body 6 is positioned so as to protecting out of the rest room to increase the volume of the space of the rest room. Reference numeral 10 denotes a supporting ring of the door body.

The supporting ring 10 is connected to the shaft 7 through a plurality of arms 11, and carries a series of roller 12 guided by a guide rail (not shown). Reference numeral 13 denotes brackets to attach the rollers 12 to the supporting ring 10, and reference numeral 14 denotes a part of a pivoting structure for pivoting the door body about the shaft 7. The door body 6 is manually or automatically pivoted with motor drive when a user goes in and out of the rest room. Reference numeral 15 denotes an engaging part to be engaged to a supporting element for supporting the door body 6.

Reference numeral 16 denotes a small-sized chair situated on a selected position on a side on which the center of curvature of the door body 6 is located. The small-sized chair 16 is situated outside that rest room 2 at state A (a vacant state waiting a user) shown in FIG. 1 and inside the rest room 2 at state B (an occupied state) shown in FIG. 2.

The small-sized chair 16 has two use. Namely, the first use of the small-sized chair 16 is for an user to put a baggage thereon when using the rest room 2. The second use is to make it easy for a user to dress oneself inside the rest room 2. The small-sized chair 16 is easy to be made cleaning and kept clean as compared with a conventional article putting stand provided for a conventional rest room.

Reference numeral 17 denotes a safety confirming window for confirming a safety of the inside or outside of the rest room 2. Only the user on the side of the center curvature of the door body 6 with a curved shape can open or shut the safety confirming window 17.

The door apparatus for a rest room of the first embodiment can increase the space of the rest room. 2 when being an occupied state and reducing the space of the rest room 2 when being a vacant state, and thus improving a use efficiency. The small-sized chair 16 is easy to be kept clean, and used for putting a relatively heavy baggage thereon, and further can be used for dressing oneself inside the rest room 2.

Second Embodiment

Next, the second embodiment is described with reference to FIGS. 6 through 9.

The basic structure is similar to the first embodiment, so that the repeated description is omitted by using the same reference numeral. In addition, a stool is omitted in the drawings.

In the second embodiment, the door body 6 is provided with a safety confirming window 18. The safety confirming window 18 is mounted at the height at which a normal user is easy to look out therethrough, for example at the height of 150 centimeters from the floor. The safety confirming window 18 can be operated only by a user on the side of the space 9, that is the side of the center of curvature of the door body 6.

Figure 7A:
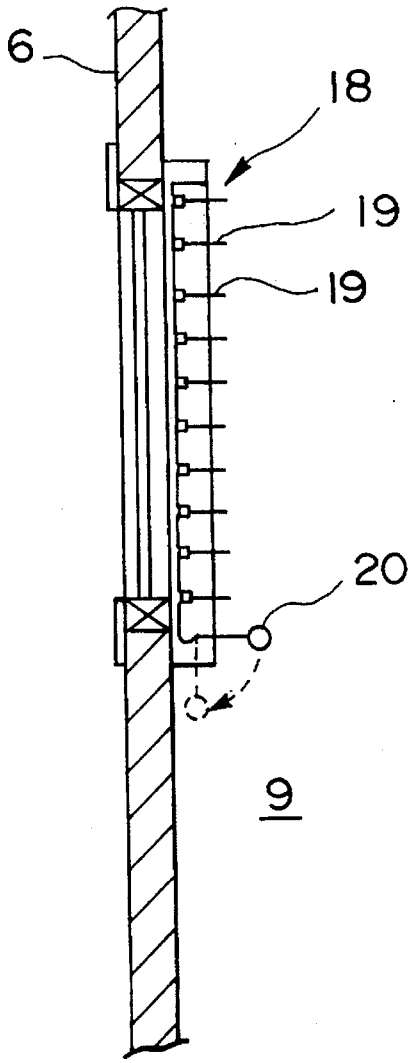
FIG. 7A is a cross sectional view showing an open state of a safety confirming window provided for the door apparatus of FIG. 6.
Figure 7B:
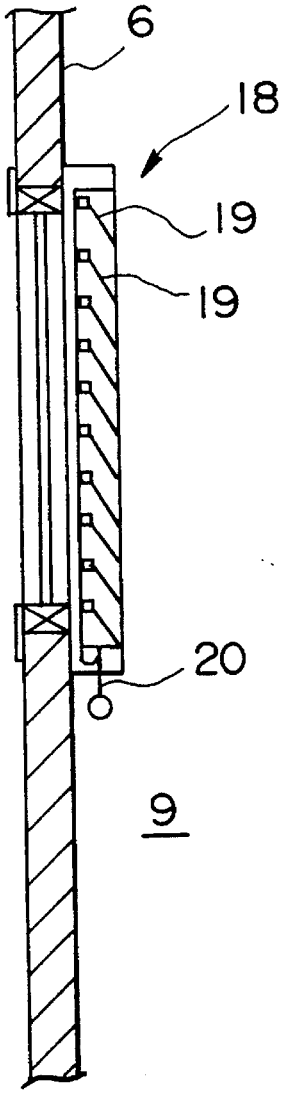
FIG. 7B is a cross sectional view showing a shut state of the safety confirming window of FIG. 7A.

The safety confirming window 18 is provided with a louver 19 which can be opened or shut by a lever 20. FIG. 7A shows a state in which the louver 19 is open, and FIG. 7B shows a state in which the louver 19 is shut. In addition, a liquid crystal shutter may be used instead of the shutter of the louver 19. A light may be switched on with interlocking with the opening and the shutting of the shutter.

In the second embodiment, a wash-hand stand 22 is situated within the space 9. The wash-hand stand 22 is secured to the floor. The wash-hand stand 22 is situated outside of the rest room 2 when the door body 6 projects to the rest room 2 (a position designated by the solid line), while situated inside of the rest room 2 when the door body 6 projects out of the rest room 2 (a position designated by the dotted line). A screen 23 is provided for preventing a user from being looked from outside when the wash-hand stand 22 is situated outside of the rest room 2. The screen 23 is situated outside of the space 9 and secured to the floor or the outer wall 1.

In the second embodiment, when the door body 6 is situated on the position designated by the solid line (open state), anyone is free to use the wash-hand stand 22 and a privacy is protected by the screen 23 during using the wash-hand stand 22. Namely, when using only the wash-hand stand 22, it is not necessary to shut the door body 6. If anyone wants to use the rest room 2, the user can confirm the safety of the inside of the rest room 2 by operating the lever 20 to open the louver 19. In the case where a light is switched on with interlocking with the lever 20, the user is further easy to confirm the safety of the inside of the rest room 2.

When the door body 6 is situated on the position designated by the dotted line, the user in of the rest room 2 can confirm the safety of the outside of the rest room 2 by operating the lever 20 at the inside of the rest room 2. In this case, since the lever 20 is situated inside the rest room 2, the user is prevented from being looked from the outside by open the louver 19. When the door body 6 is situated on the position designated by the dotted line, the wash-hand stand 22 is situated inside the rest room 2 so that the user can use the wash-hand stand 22 without minding others eyes.

Figure 8:
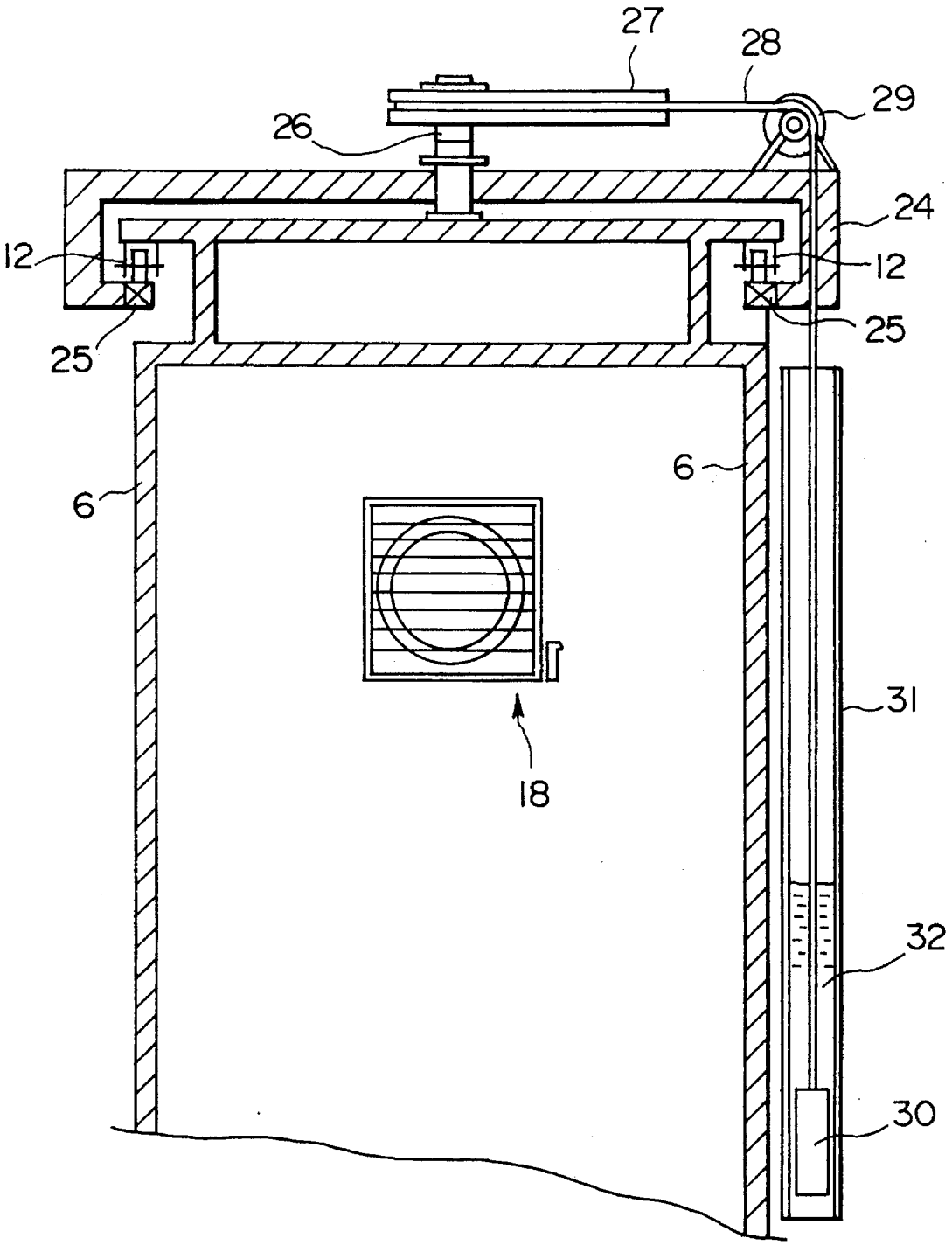
FIG. 8 is a cross sectional view showing a door supporting structure provided for the door apparatus of FIG. 6.
Figure 9:
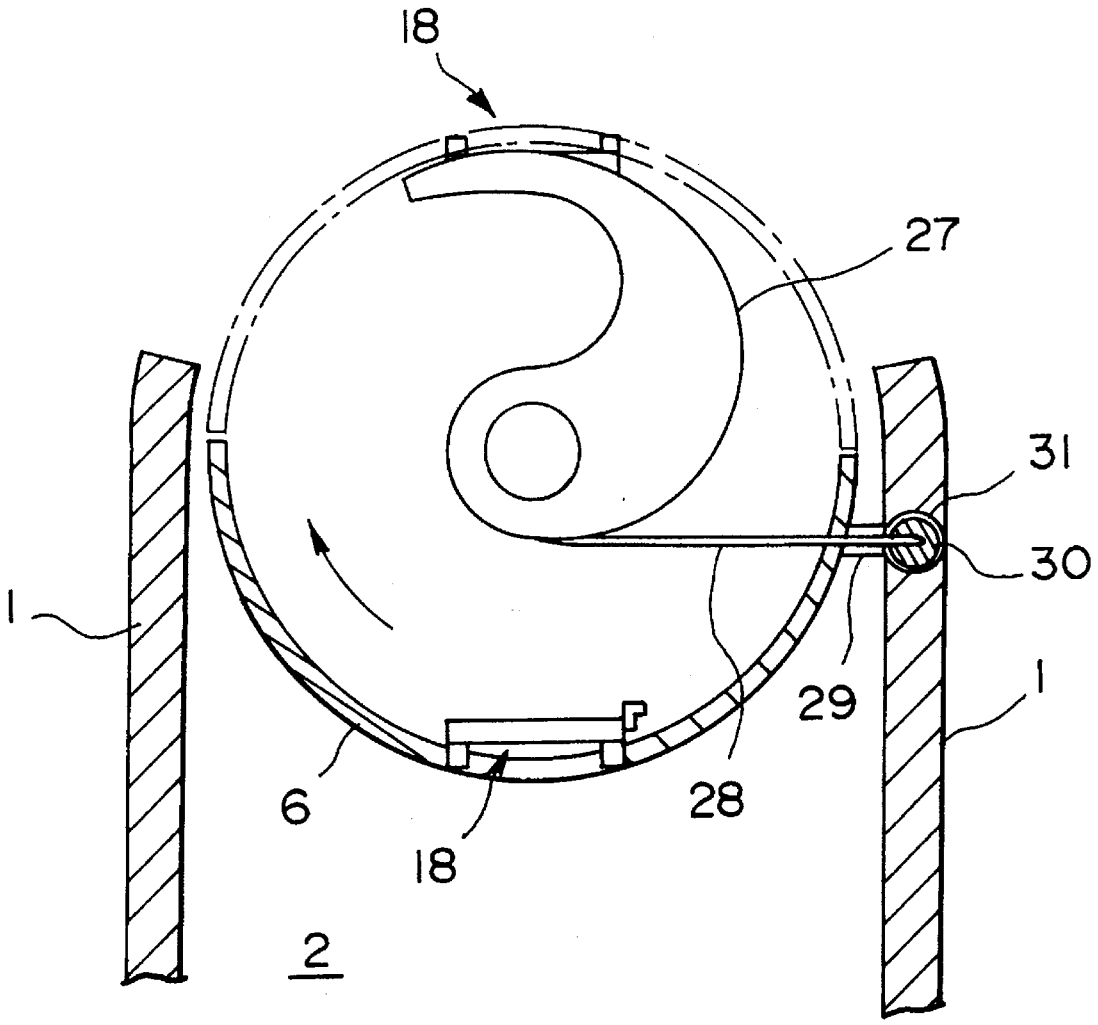
FIG. 9 is a plan view showing a door driving device provided for the door apparatus of FIG. 6.

FIG. 8 shows a supporting structure for the door body 6, and FIG. 9 shows a door driving device.

The door body 6 carries a plurality of rollers 12 at upper portion thereof. The rollers 12 get on the rail 25 of the door supporting member 24. The rail 25 is formed in ring-shape. A shaft 26 extends upwardly from the top of the door body 6, penetrating the supporting member 24 and integrally connected with the pulley 27. The outer periphery of the pulley 27 is formed in an involute-shape or a spiral shape similar to the same. A wire 28 is wound about the pulley 27 and one end thereof is secured to the pulley 27. The wire 28 extends in a horizontal direction and turns the roller 29 to extend in the vertical direction and is connected to the weight 30 at a lower end thereof. The weight 30 is inserted into the tube 31 in which oil 32 is received. The tube 31 extends in the vertical direction within the outer wall 1.

In the configuration described above, the user can enter into the rest room 2 by manually pivoting the door body 6 in a direction designated by the arrow in FIG. 9, and can close the entrance by further pivoting the door body 6 to the position designated by the dotted line to lock the same. In this case, the weight 30 moves upwardly within the tube 31 by winding the wire 28 through the pulley 27.

When releasing the lock after using the rest room 2, the door body 6 is a automatically pivoted by the weight 30 in the direction reverse to the direction designated by the arrow. In this case, because the outer periphery of the pulley 27 has an involute-shape, at the initial stage of pivoting the door body 6 is pivoted by a strong torque and at the later stage of pivoting the door body 6 is pivoted by a relatively weak torque. Further, when the weight 30 enters into oil 32, the weight 30 slowly sinks in oil 32, and therefore the door body 6 is slowly and quietly closed. Moreover, in this configuration, even if the user leaves the rest room 2 without closing the door body 6, the door body 6 is pivoted by the weight 30 to be closed.

In addition, although the pulley 27 having an involute-shape is used in the embodiment described above, other pulley or gear having other curved-shape or a combined shape of straight line may be used if it can change the rotational moment of the door body 6.

Third Embodiment

Figure 10:
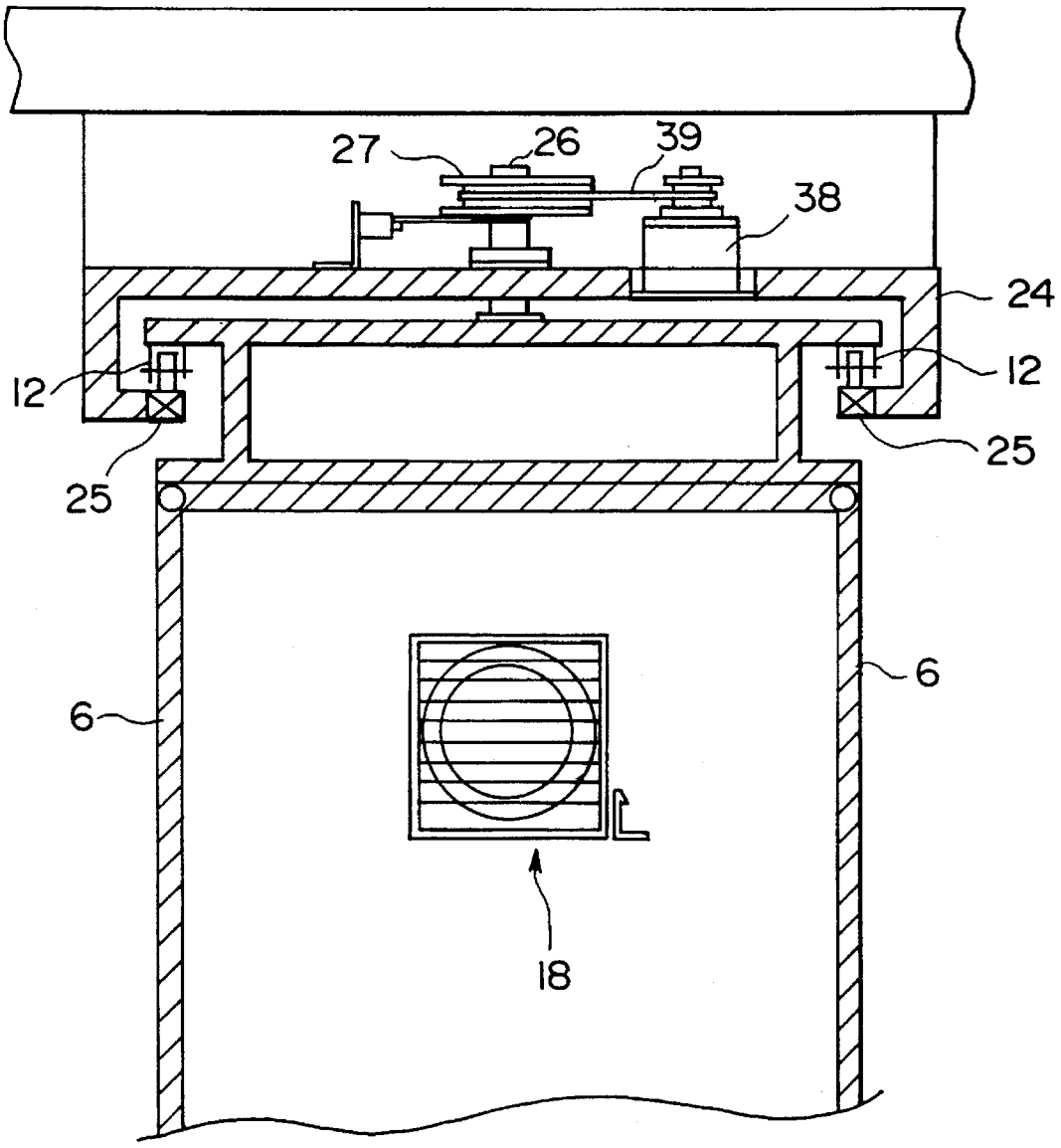
FIG. 10 is a cross sectional view Showing a door driving device provided for the third embodiment of the present invention.
Figure 11:
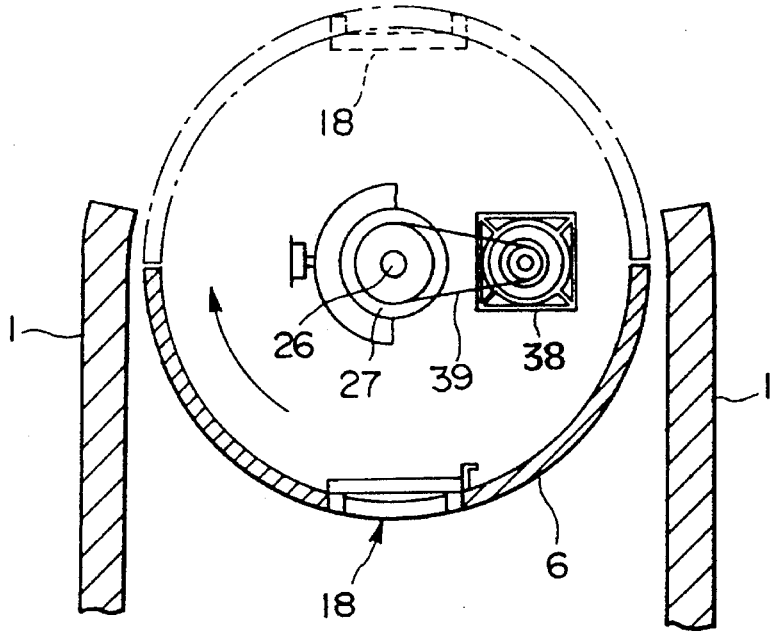
FIG. 11 is a plan view showing the door driving device of FIG. 10.

FIG. 10 shows a supporting structure for the door body 6 provided for the third embodiment of the present invention, and FIG. 11 shows a door driving motor mounted on the supporting structure. The basic structure of this embodiment is similar to that of the second embodiment.

The door body 6 carries a plurality of rollers 12 at the upper portion thereof and the rollers 12 are gotten on the rail 25 of the door supporting member 24. The rail 25 has a ring shape. A shaft 26 upwardly extends from the top of the door body 6 and penetrates the door supporting member 24 and is integrally connected to a pulley 27 at the upper end thereof. The pulley 27 is rotated by a driving motor 38 mounted on the door supporting member 24 through a belt 39.

Fourth Embodiment

The fourth embodiment relates to a door apparatus for a rest room which is preferably used for a place in which an external appearance is important such as a lobby in a hotel.

Usually, so-called rest room has three forms. The first form is "rest room=toilet" the second form is "rest room= powder room" and the third form is "rest room =powder room+toilet". The third form is the most in these three forms, and installed in a lobby or the like of a hotel in which a relatively gay atmosphere is required.

In the case where the rest room is installed in a lobby of a hotel, the second form, that is only used as a powder room, is preferable in view of a relatively gay atmosphere. However, usually the rest room of the third form is installed in a recess through a curved passage. However, the rest room situated in a recess through a curved passage is inconvenient for us, and therefore the rest room should be situated in a place which is near and easy to be find if possible. Consequently, this embodiment provides a door apparatus for a rest room which can be installed in a place which easy to be found such as a lobby of a hotel.

Figure 12:
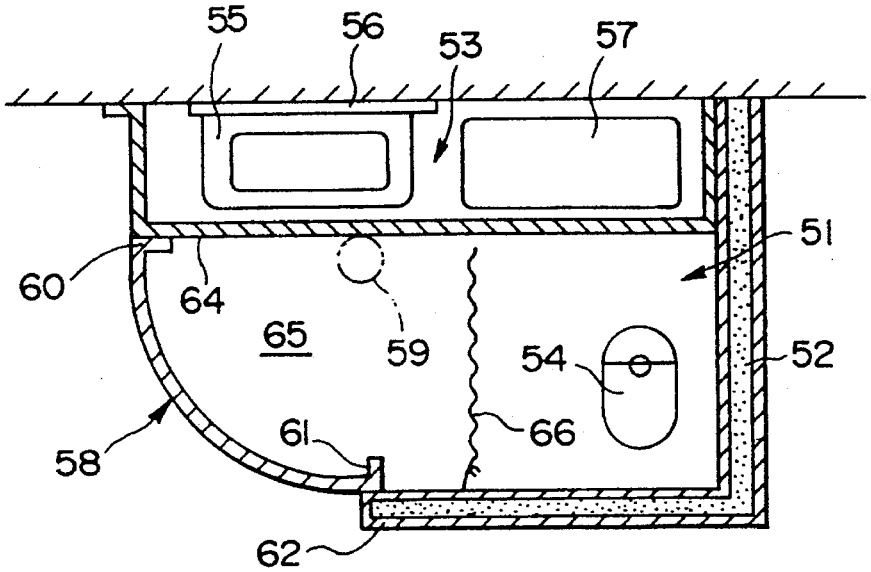
FIG. 12 is a cross sectional view showing the fourth embodiment of a door apparatus for a rest room according to the present invention.
Figure 13:
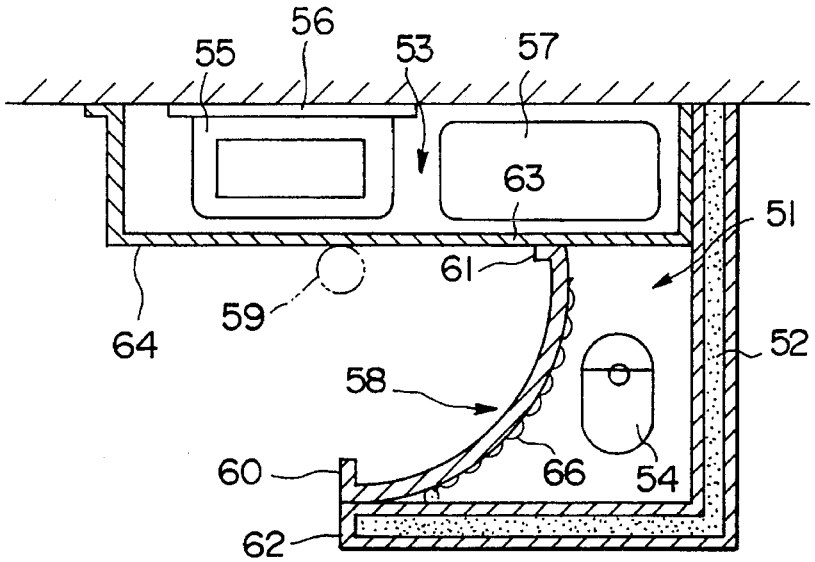
FIG. 13 is a cross sectional view showing the door apparatus at another state different from FIG. 12.

FIG. 12 is a cross sectional view showing a fourth embodiment of a door apparatus for a rest room according to the present invention at a closed state of a rotary door, FIG. 13 is a cross sectional view showing the door apparatus for a rest room shown in FIG. 12 at an opened state of the rotary door.

In the drawings, reference numeral 51 denotes a rest room defined by a soundproof Outer wall 52, reference numeral 53 denotes a powder room. The rest room 51 is arranged along one arm of L-shape, the powder room 53 is arranged along the other arm of L-shape. Reference numeral 54 denotes a stool disposed in the rest room 51, reference numerals 55, 56, 57 denote a wash-hand stand, a mirror, and a bed for a baby care, respectively.

Reference numeral 58 denotes a rotary door of the toilet 51 and the powder room 53, and reference numeral 59 denotes a shaft to support the rotary door 58. The rotary door 58 can be positioned on "open state" shown in FIG. 13 and "close state" shown in FIG. 12 with respect to "toilet 51+powder room 53"="rest room". At the state in which the rotary door 58 is open, that is "vacant state" shown in FIG. 13, one edge 60 of the curve of the rotary door 58 is positioned next to a part 62 of the outer wall of the toilet 51, while the other edge 61 of the curve of the rotary door 58 is positioned next to a part of wall of the powder room 53. At the state in which the rotary door 58 is close, that is "occupied state" shown in FIG. 12, one edge 60 is positioned next to a part 64 of the wall of the powder room 53, while the other edge 61 is positioned next to a part 62 of the outer wall of the toilet 51. Reference numeral 65 denotes a space for the powder room 53 defined by the rotary door 58 when it is closed. This space 65 is shut off from the outside when it is "occupied state". The rotary door 58 is opened or closed by a motor drive which is operated by a manual switch or foot switch.

Reference numeral 66 denotes a screen for the stool 54. The screen 66 is supported by the toilet 51 or powder room 53 at the end thereof, and wound against a spring force or moved with following the movement of the rotary door 58 as shown in FIG. 13. TO make the states shown in FIGS. 12 and 13 stable, extending walls with a proper length are preferably provided on the edges 60 and 61 of the rotary door 58.

This embodiment makes it possible to situate a rest room on a place in which a gay atmosphere is important and should be prevented from being hurt. The door apparatus for a rest room of this embodiment is installed as a powder room on a place in which a gay atmosphere is important and the powder room serves as it is.

Fifth Embodiment

Although a rest room of a large-sized construction is usually situated on a recess so as to be inconspicuous, it is not preferable in view of using the rest room. In other wards, the rest room of the large-sized construction is preferably situated on a place which is easy to be found as far as it is not unsightly. While it should be emphasized with respect to a rest room for a physically handicapped person, actually it is apt to be ignored. This is because a conventional rest room does not have a proper external appearance for installing them on an optional place in a large-sized construction without a hindrance. Although a lot of rest rooms are acceptable a wheelchair, such rest rooms are also situated on a recess so as to be inconspicuous.

Therefore, this embodiment provides a door apparatus for a rest room which can be installed on a wide place which is easy to be used.

FIGS. 14 through 23 are explanatory views showing a door apparatus for a rest room with following the change in a rotary door thereof. In these drawings. FIGS. 14 to 18 show a series of steps of entering into the rest room, and FIGS. 19 to 23 show a series of steps of going out the rest room. In these drawings, reference numeral 81 denotes a rest room, reference numerals 52, 83 denote walls, and reference numeral 84 denote a rotary door.

The rotary door 84 consists of a pair of half-cylindrical door members 85, 86 which are separated each other. The door members 85, 86 consisting the rotary door 84 can rotate relatively each other as shown in FIGS. 14 to 18 and FIGS. 19 to 23.

Figure 14:
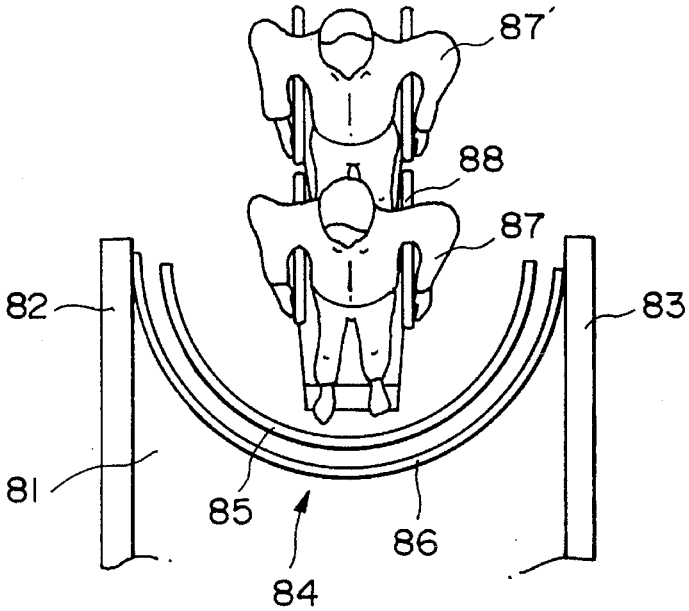
FIG. 14 shows the first step in using the fifth embodiment of a door apparatus for a rest room according to the present invention.

In FIG. 14, reference numeral 87 denotes a user getting on a wheelchair 88, both user 87, 87', who has gone in the predetermined position and before going in, respectively, are indicated in the same drawing. FIG. 14 shows the first step in using the rest room 81.

Figure 15:
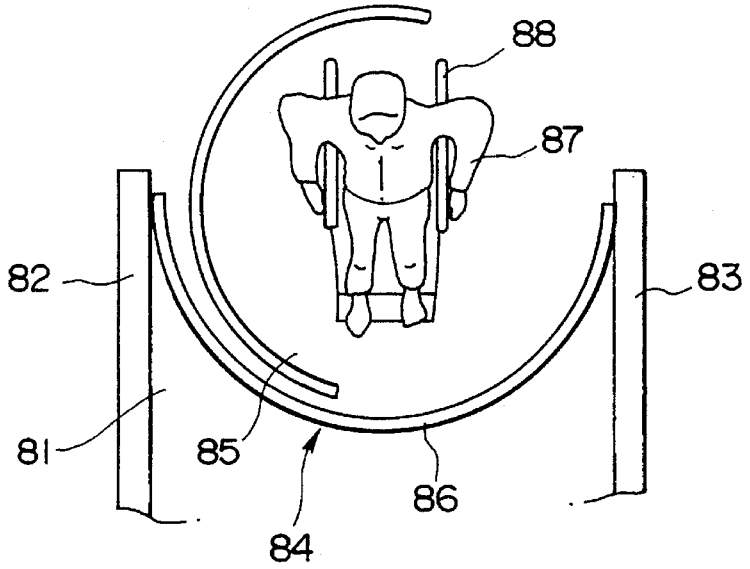
FIG. 15 shows the second step using the door apparatus of FIG. 14.

One door element 85 out of the door elements 85, 86 consisting the rotary door 84 is rotated in a clockwise direction, so that the rotary door 84 proceeds from the state of FIG. 14 to the state of FIG. 15. One or both of the door elements 85, 86 is preferably rotated by an oil cylinder (not shown).

Figure 16:
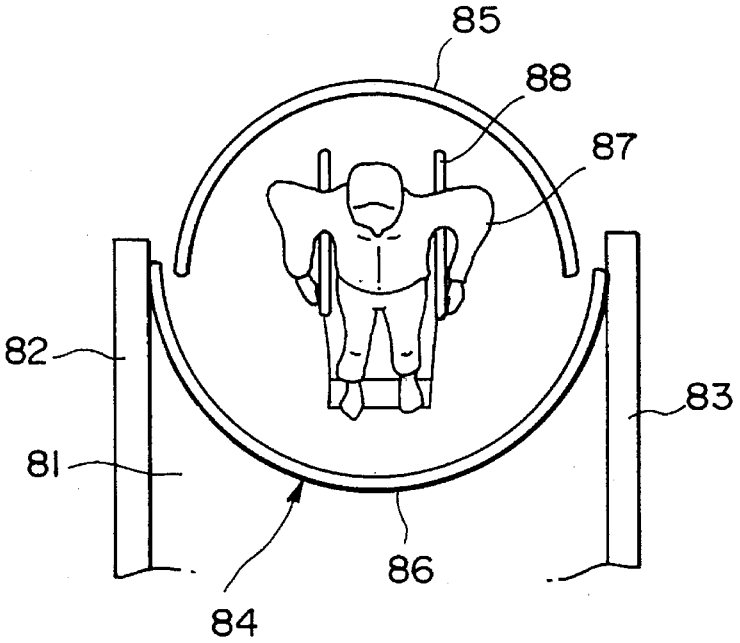
FIG. 16 shows the third step using the door apparatus of FIG. 14.

When the door element 85 is further rotated in a clockwise direction from the state of FIG. 15, the rotary door 84 proceeds the state of FIG. 16. This state indicates the third step in using the rest room 81, and in this state the user 87 is surrounded by the door elements 85, 86 of the rotary door 84.

Figure 17:
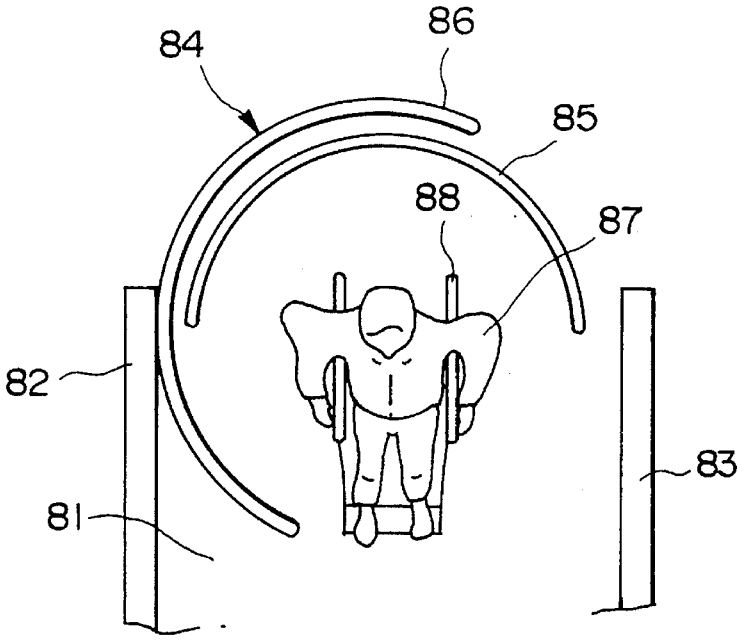
FIG. 17 shows the fourth step using the door apparatus of FIG. 14.
Figure 18:
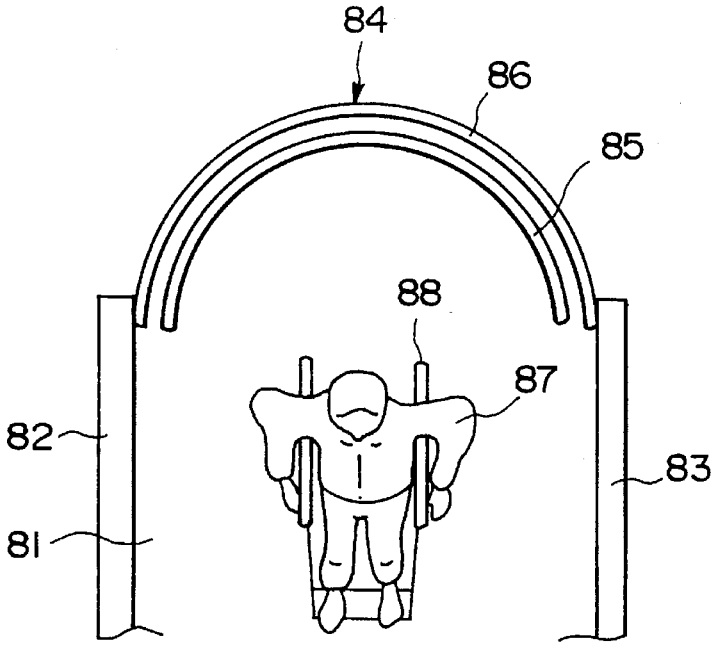
FIG. 18 shows the fifth step using the door apparatus of FIG. 14.

When the door element 85 is further rotated in a clockwise direction from the state of FIG. 16, the rotary door 84 proceeds the fourth step shown in FIG. 17. When the door element 85 is further rotated in a clockwise direction from the state of FIG. 17, the rotary door 84 proceeds the state at which a volume V of the rest room 81 becomes the maximum value V2 as shown in FIG. 18. This stage indicates the fifth step in using the rest room 81, and the rest room 81 is used by the user 87 at this state at which the volume V of the rest room 81 is the maximum value V2.

Figure 19:
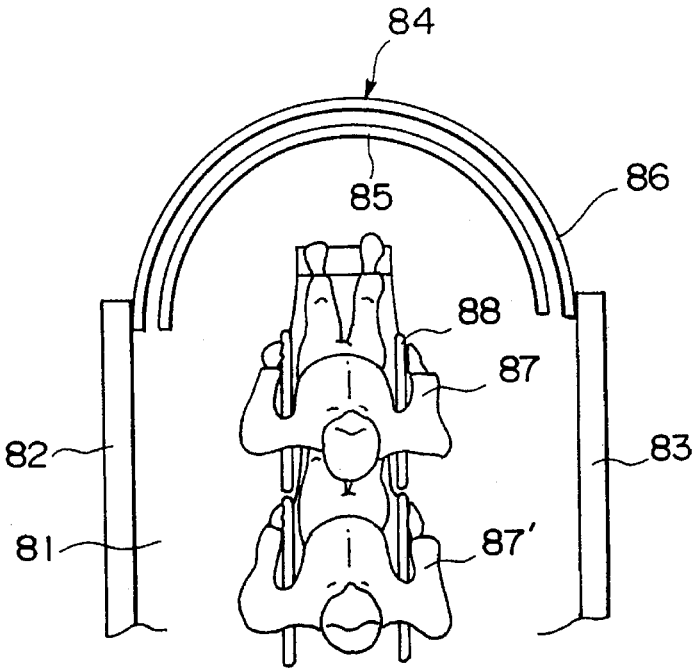
FIG. 19 shows the sixth step using the door apparatus of FIG. 14.
Figure 20:
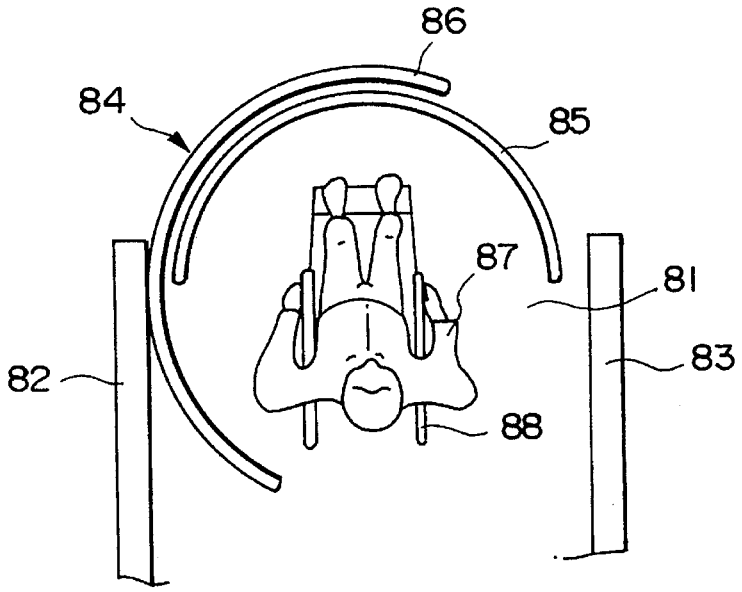
FIG. 20 shows the seventh step using the door apparatus of FIG. 14.
Figure 21:
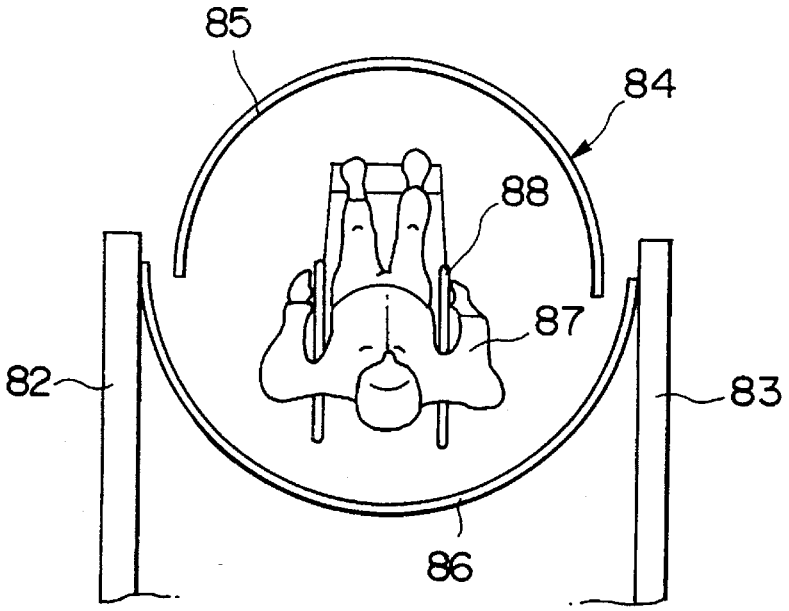
FIG. 21 shows the eighth step using the door apparatus of FIG. 14.
Figure 22:
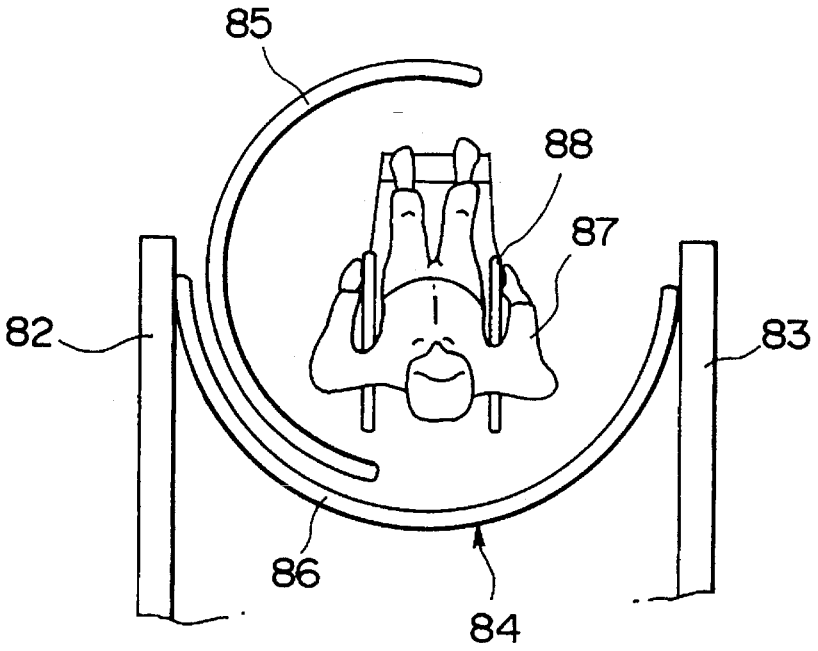
FIG. 22 shows the ninth step using the door apparatus of FIG. 14.
Figure 23:
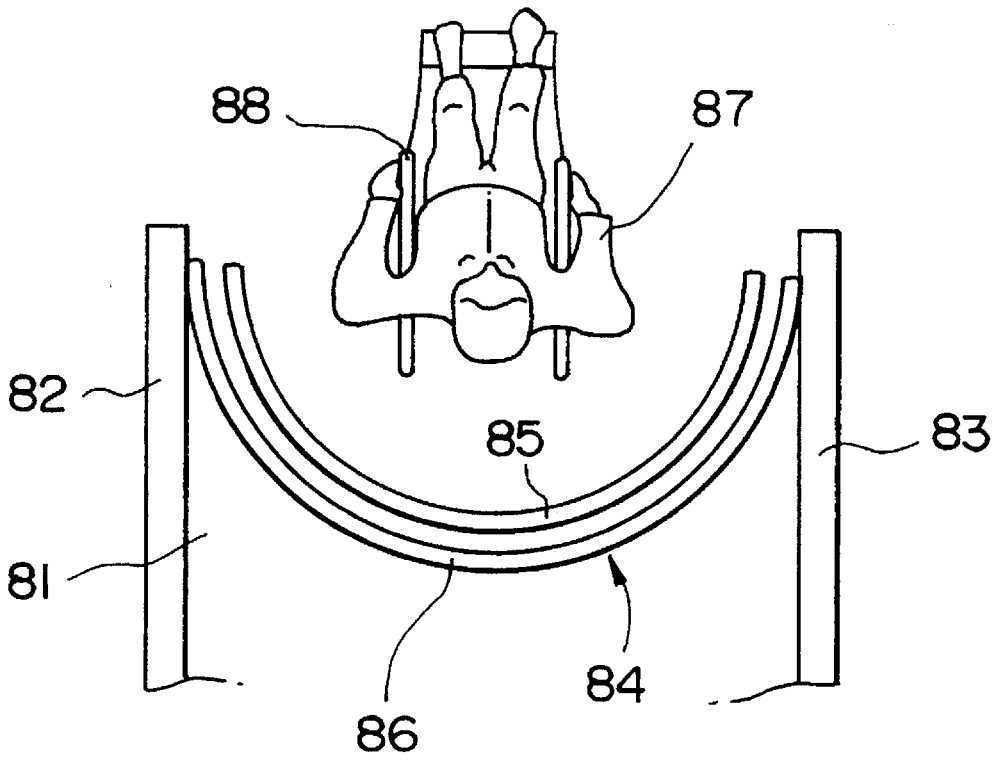
FIG. 23 shows the tenth step using the door apparatus of FIG. 14.

When rotating the wheelchair 88 at the angle of 180 degrees from the state of FIG. 18, the step proceeds to the state shown in FIG. 19 (the sixth step). The user 87 goes out of the rest room from the state of FIG. 19 through the process of FIGS. 20, 21, 22 and 23 (the seventh step through the tenth step).

As well understood from the above, this embodiment can make the volume of the rest room large enough at use, while this rest room is excellent in the external appearance, so that this rest room can be situated on the center of the large-sized construction without inconvenience such as unsightly appearance.

What is claimed is:

1. A door apparatus for a rest room, comprising:

wall means defining a predetermined space with an opening for entrance into and exit from said space a door means for opening or closing said space, said door means comprising a pair of substantially half-cylindrical door members which are separated from each other and are rotatable about the center of curvature of said door members, and drive means for driving and rotating said door members about the center of curvature.

2. Apparatus according to claim 1 whereby said drive means comprises variable torque means having stronger torque when beginning to close the door members and weaker torque as the door members are moved toward being closed.

3. A door apparatus for a rest room, comprising:

wall means defining a predetermined space with an opening for entrance into and exit from said space, door means for opening or closing said space comprising a pair of first and second substantially concentric partial-cylindrical door members which are separated from each other and are rotatable about their center of curvature, said door members being positionable to extend convexly inward whereby the space is minimum, or to extend convexly outward whereby the space is maximum, and drive means for driving and rotating said first and said second door members about their center of curvature.

4. A door apparatus according to claim 3 wherein said drive means comprises motor means.

5. A door apparatus according to claim 3 further comprising:

a safety-confirming window in said door means, a shutting member disposed on said door means for opening and closing said safety confirming window, and a screen for partially closing said opening, said screen situated adjacent said wall means and outside of a radius of rotation of said door means.

6. Apparatus according to claim 3 whereby said drive means comprises variable torque means having stronger torque when beginning to close the door members and weaker torque as the door members are moved toward being closed.

7. A door apparatus for a rest room, comprising:

wall means defining a predetermined space with an opening for entrance into and exit from said space, door means for opening or closing said space comprising at least a pair of first and second substantially concentric partial-cylindrical door members which are separated from each other and are rotatable about their center of curvature, said door members being positionable to extend convexly inward whereby the space is minimum, or to extend convexly outward whereby the space is maximum, and means for driving and rotating said first and said second door members about their center of curvature.

* * * * *

UNITED STATES PATENT AND TRADEMARK OFFICE

CERTIFICATE OF CORRECTION

PATENT NO. : 5,605,014
DATED : Feb. 25, 1997
INVENTOR(S) : Motoyasu Kimura

It is certified that error appears in the above-indentified patent and that said Letters Patent is hereby corrected as shown below:

Column 2, line 10, before "tube", insert --by a --.

Column 2, line 11, after "weight", insert --is--.

Column 7, line 56, delete "52" and insert --82--.

Signed and Sealed this

Twenty-first Day of October 1997

*Attest:*

*Attesting Officer*

BRUCE LEHMAN

*Commissioner of Patents and Trademarks*